US005850666A

United States Patent [19]

Farone et al.

[11] Patent Number: 5,850,666

[45] Date of Patent: Dec. 22, 1998

[54] UPRIGHT VACUUM CLEANER

[75] Inventors: Richard C. Farone, Wickliffe; Craig M. Saunders, Rocky River; Jeffrey M. Kalman; Paul D. Stephens, both of Cleveland Heights; Robert A. Salo, Mentor; Charles J. Thur, Broadview Heights; Michael F. Wright, Stow, all of Ohio

[73] Assignee: Royal Appliance Mfg. Co., Cleveland, Ohio

[21] Appl. No.: 781,805

[22] Filed: Jan. 10, 1997

[51] Int. Cl.[6] ..... A47L 9/00

[52] U.S. Cl. ..... 15/339; 15/351

[58] Field of Search ..... 15/339, 351

[56] References Cited

U.S. PATENT DOCUMENTS

| | | | |
|---|---|---|---|
| D. 371,654 | 7/1996 | WoRwag . | |
| 2,348,861 | 5/1944 | Smellie . | |
| 2,930,068 | 3/1960 | Evanson et al. | 15/351 X |
| 3,942,219 | 3/1976 | Johnson . | |
| 4,318,202 | 3/1982 | Holman | 15/328 |
| 4,357,177 | 11/1982 | Knox | 15/338 X |
| 4,513,469 | 4/1985 | Godfrey et al. | 15/339 X |
| 4,959,885 | 10/1990 | Sovis et al. . | |
| 5,090,083 | 2/1992 | Wulff . | |
| 5,347,679 | 9/1994 | Saunders et al. . | |
| 5,500,979 | 3/1996 | Worwag . | |

*Primary Examiner*—Chris K. Moore

*Attorney, Agent, or Firm*—Fay, Sharpe, Beall, Fagan, Minnich & McKee

[57] ABSTRACT

An upright vacuum cleaner is provided and includes an upper section with a handle (15) and a lower cleaning nozzle section (14, 14') having a main suction opening (18) formed in the underside (16) thereof. A suction source (M) is provided and an edge cleaning tool (60) having a suction bore (64) formed therethrough is releasably connected to the cleaning nozzle section (14'). A suction hose (20) selectively connects one of the main suction opening (18) of the nozzle (14') and the suction bore (64) of the edge cleaning tool (60) with the suction source (M). First and second laterally spaced casters **(30*a*, 30*b*) extend from the underside (16) of the nozzle (14, 14') and each caster (30*a*, 30*b*) is pivotable respectively about a vertical axis (D,E). First and second laterally spaced fixed wheels (32*a*, 32*b*), each rotatable about a single rolling axis (C), are also provided and positioned forward of the first and second casters (30*a*, 30*b*). Each fixed wheel (32*a*, 32*b*) includes a rolling surface (40*a*, 40*b*) and curved inner and outer transition surfaces (42*a*, 42*b*), (44*a*, 44*b*) connecting its rolling surface (40*a*, 40*b*) to the inner and outer sides (42*a*, 42*b*), (44*a*, 44*b*) of the wheel (32*a*, 32*b*)**.

2 Claims, 7 Drawing Sheets

UPRIGHT VACUUM CLEANER

BACKGROUND OF THE INVENTION

The present invention relates to vacuum cleaners. More particularly, the present invention relates to upright vacuum cleaners used for suctioning dirt and debris from carpets and floors.

Upright vacuum cleaners are ubiquitous. They are known to include an upper portion having a handle, by which an operator of the vacuum cleaner may grasp and maneuver the cleaner, and a lower cleaning nozzle portion which travels across a floor, carpet, or other surface being cleaned. The upper portion is often formed as a rigid plastic housing which encloses a dirt and dust collecting filter bag, although the upper portion may simply be an elongated handle with the filter bag, and an external cloth bag, being connected thereto. The cleaning nozzle is hingedly connected to the upper portion such that the upper portion is pivotable between a generally vertical upright storage position and an inclined operative position. The underside of the nozzle includes a suction opening formed therein which is in fluid communication with the filter bag.

A vacuum or suction source such as a motor and fan assembly is enclosed either within the nozzle portion or the upper portion of the cleaner. The vacuum source generates the suction required to pull dirt from the carpet or floor being vacuumed through the suction opening and into the filter bag. A rotating brush assembly is typically provided in proximity to the suction opening to loosen dirt and debris from the carpet being vacuumed.

While upright vacuum cleaners are generally very effective and are in widespread use, there has been found a need to provide a more effective and easy to use upright vacuum cleaner. Specifically, although attempts have been made to provide an upright vacuum cleaner for suctioning dirt from the corners and edges of a room, these prior edge and corner cleaning upright vacuum cleaners have not been entirely effective or easy to use. The lack of complete effectiveness generally results from the inability to extend the suction opening of the vacuum cleaner nozzle completely to or beyond the edges of the nozzle housing. Furthermore, when attempting to clean edges and corners of a room with known upright vacuum cleaners, the housing of the nozzle interferes with the walls and prevents the suction opening of the nozzle from being moved close to the wall as is required for effective corner and edge cleaning.

Prior edge cleaning vacuums have also been relatively complex and expensive to manufacture. The edge cleaning mechanisms have been permanently incorporated into the cleaning nozzle of the vacuum, and have required the operator of the vacuum to operate a lever, knob, or the like to divert a portion of the suctioning force away from the main suction opening in the underside of the nozzle to the edge/corner cleaning assembly.

One deficiency associated with known edge cleaning mechanisms is the inability of these mechanisms to divert a sufficient amount of the available suction to the edge cleaning assembly. Instead, during edge and corner cleaning operations, the suction is present at both the main suction opening and the edge cleaning suction opening, resulting in less powerful suction at both locations. This results in an ineffective suctioning of dirt and debris from the edges and corners.

Another deficiency of known upright vacuum cleaners, both with and without edge cleaning capabilities, is the difficulty encountered in maneuvering these cleaners over carpets and floors. Most upright vacuum cleaners include four wheels extending from the underside of the nozzle, with one wheel located at or near each corner of the nozzle. Each wheel rotates about a horizontal axis but is otherwise fixed in position, i.e., the wheels do not pivot about a vertical or near vertical axis. While some prior vacuum cleaners have utilized casters to facilitate maneuverability, these prior vacuums have either used all casters, which can make control of an upright vacuum cleaner difficult in light of the repetitive back and forth vacuuming motion utilized, or have combined casters with narrow profile fixed wheels formed with a sharp transition (often close to 90 degrees) between the rolling surface and the side or hub portion thereof. These sharply transitioned wheels have been found to limit the maneuverability of a vacuum cleaner, especially if they were to be used in conjunction with casters. The sharp transition area between the rolling surface and the side of each wheel becomes engaged with a subadjacent carpet upon any lateral sliding movement or twisting of the wheel and thus limits the ability of the forward wheels to twist or slide laterally across a surface being cleaned as is required upon pivoting the vacuum upon its casters. The sharply transitioned wheels have also been found to mar the finish on uncarpeted floors.

The maneuverability of an upright cleaner is especially important when the cleaner is to be utilized for edge and corner cleaning. It is more difficult to maneuver the nozzle of an upright cleaner into the area of a room adjacent to the walls for edge and corner cleaning operations. Prior upright vacuum cleaners with edge cleaning capabilities have not included wheels that allow the cleaner to be easily and effectively maneuvered into areas adjacent to edges and corners of the room being cleaned. Prior edge cleaning vacuums have generally not included casters or any other similar wheels that enhance maneuverability. They have included merely fixed wheels, rotatable about only a single, generally horizontal axis. Thus, maneuvering these prior edge cleaning vacuums into position as required for edge and corner cleaning has required the wheels to be slid laterally across the surface being vacuumed or has required the operator of the vacuum to lift the front and/or rear wheels from the surface being vacuumed in order to move the front or rear of the nozzle laterally to position the nozzle adjacent to an edge or corner of a room. Therefore, these prior upright cleaners with edge cleaning capabilities have not been easy to utilize and have consequently been less effective in cleaning the areas near walls and in corners.

Accordingly, it is desirable to develop a new and improved upright vacuum cleaner which would overcome the foregoing difficulties and others while providing better and more advantageous overall results.

SUMMARY OF THE INVENTION

According to the present invention, a new and improved upright vacuum cleaner is provided.

In accordance with a first aspect of the present invention, an upright vacuum cleaner is provided and includes an upper section with a handle and a lower cleaning nozzle section having a main suction opening formed in the underside thereof. A suction source and an edge cleaning tool having a suction bore formed therethrough are provided. A fastener is provided as a part of one of the lower cleaning nozzle section and the edge cleaning tool and selectively connects the edge cleaning tool to the lower cleaning nozzle section. Conduit means, such as a hose, selectively connects one of the main suction opening of the nozzle and the suction bore of the edge cleaning tool with the suction source.

In accordance with another aspect of the present invention, a vacuum cleaner is provided and comprises a cleaning nozzle having a nozzle cover with first and second forward corners. First and second edge cleaning tool connection sockets are formed through the nozzle cover in the region of the forward corners. An edge cleaning tool is provided and includes a connection flange extending therefrom. The flange is slidably received in either one of the first and second connection sockets of the nozzle cover such that the edge cleaning tool is selectively connected to and extends outward from one of the forward corners of the nozzle.

In accordance with yet another aspect of the present invention, an upright vacuum cleaner is provided and includes an upper section including a handle and a lower cleaning nozzle section. The underside of the cleaning nozzle section includes a main suction opening formed therethrough. First and second laterally spaced casters extend from the underside of the nozzle and each caster is pivotable about a vertical axis and each includes a wheel rotatable about a rolling axis. First and second laterally spaced fixed wheels, each rotatable about a single rolling axis, are also provided and positioned forward of the first and second casters. Each fixed wheel includes a rolling surface and curved inner and outer transition surfaces connecting its rolling surface to the inner and outer sides of the wheel.

In accordance with another aspect of the present invention, an upright vacuum cleaner is provided and includes an upper section and a lower cleaning nozzle section connected to the upper section. The cleaning nozzle section includes at least one edge cleaning tool connection socket formed in a surface thereof. An edge cleaning tool is selectively connected to the lower cleaning nozzle section. The edge cleaning tool includes a suction bore formed therethrough and includes an attachment arm extending therefrom. The attachment arm includes a connection flange extending therefrom for insertion into the at least one connection socket of the nozzle.

In accordance with a more limited aspect of the present invention, the edge cleaning tool connection sockets of the nozzle each include at least one recess formed in the wall thereof, and the connection flange of the edge cleaning tool includes at least one projection extending therefrom such that the edge cleaning tool is retained in the connection sockets with a snap fit.

One advantage of the present invention is the provision of a new and improved vacuum cleaner.

Another advantage of the present invention is the provision of an upright vacuum cleaner with a selectively attachable edge cleaning tool that is easily and positively connected to the nozzle of the vacuum cleaner for edge and corner cleaning as needed.

Still another advantage of the present invention is the provision of a vacuum cleaner with an edge cleaning tool that receives substantially all of the available suction force for effective cleaning of edges and corners of a room.

Yet another advantage of the present invention is the provision of an upright vacuum cleaner having an edge cleaning tool that is positioned to extend outward from the nozzle of the vacuum cleaner and includes a tip that is shaped to correspond with a corner of a room.

A further advantage of the present invention is the provision of an upright vacuum cleaner having improved maneuverability and operator control.

A still further advantage of the present invention is the provision of a vacuum cleaner including rear casters for improved maneuverability.

A yet further advantage of the present invention is the provision of a vacuum cleaner with rounded forward wheels to improve the maneuverability of the cleaner and to prevent damage to a surface being cleaned.

Still other benefits and advantages of the invention will become apparent to those skilled in the art upon reading and understanding the following detailed description.

BRIEF DESCRIPTION OF THE DRAWINGS

The invention may take form in certain components and structures preferred embodiments of which will be illustrated in the accompanying drawings wherein.

DETAILED DESCRIPTION OF THE PREFERRED EMBODIMENTS

Figure 1:
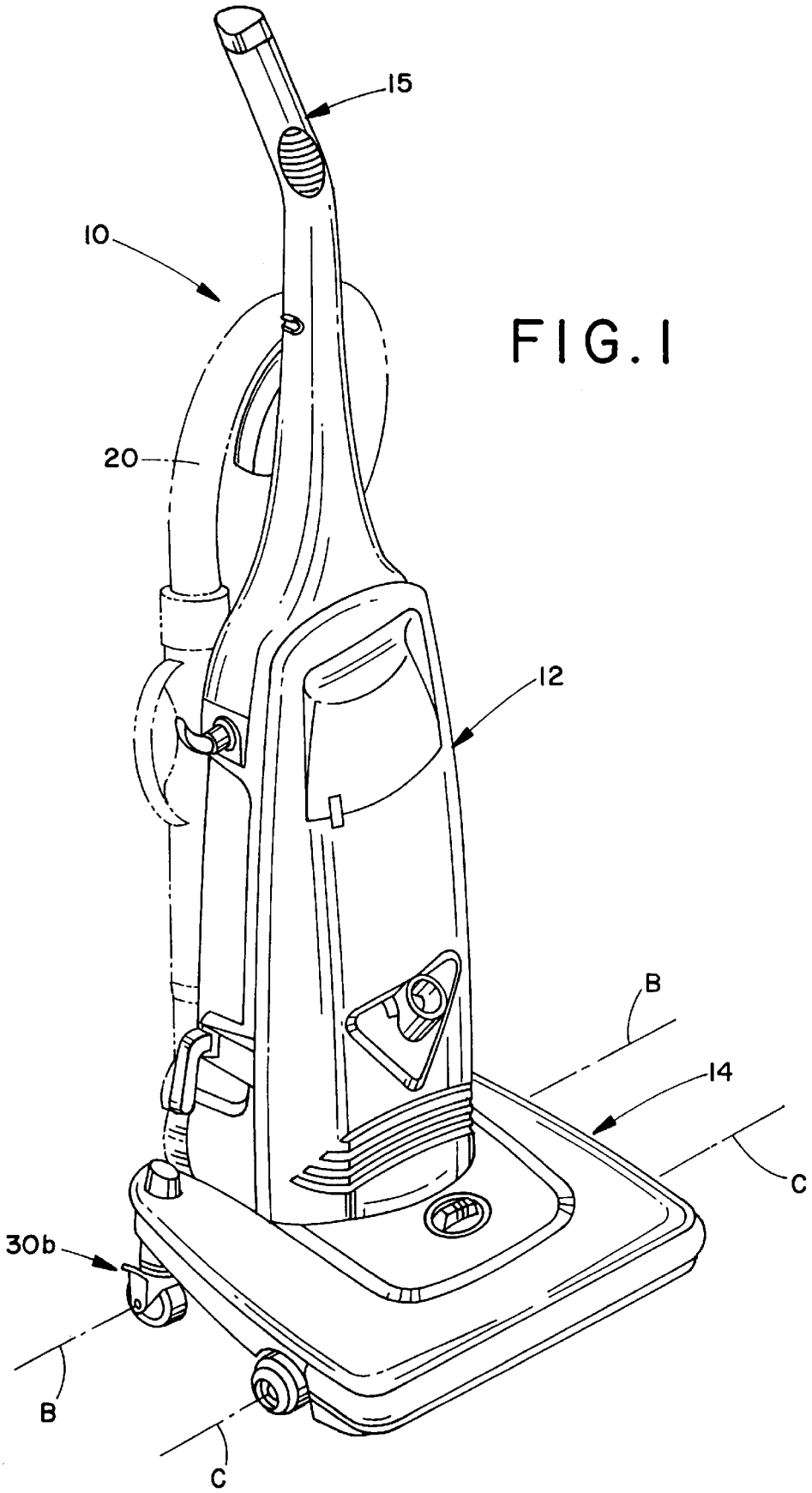
FIG. 1 is a perspective view of an upright vacuum cleaner in accordance with a first embodiment of the present invention.
Figure 2:
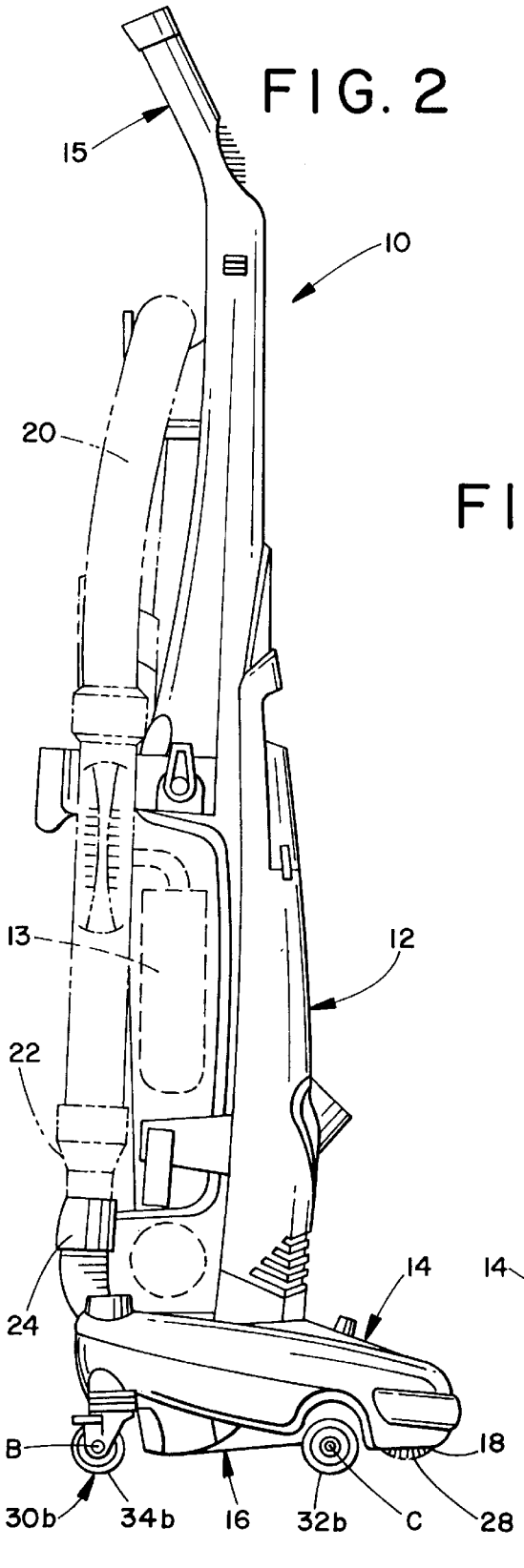
FIG. 2 is a side elevational view of the upright vacuum cleaner illustrated in FIG. 1.
Figure 3:
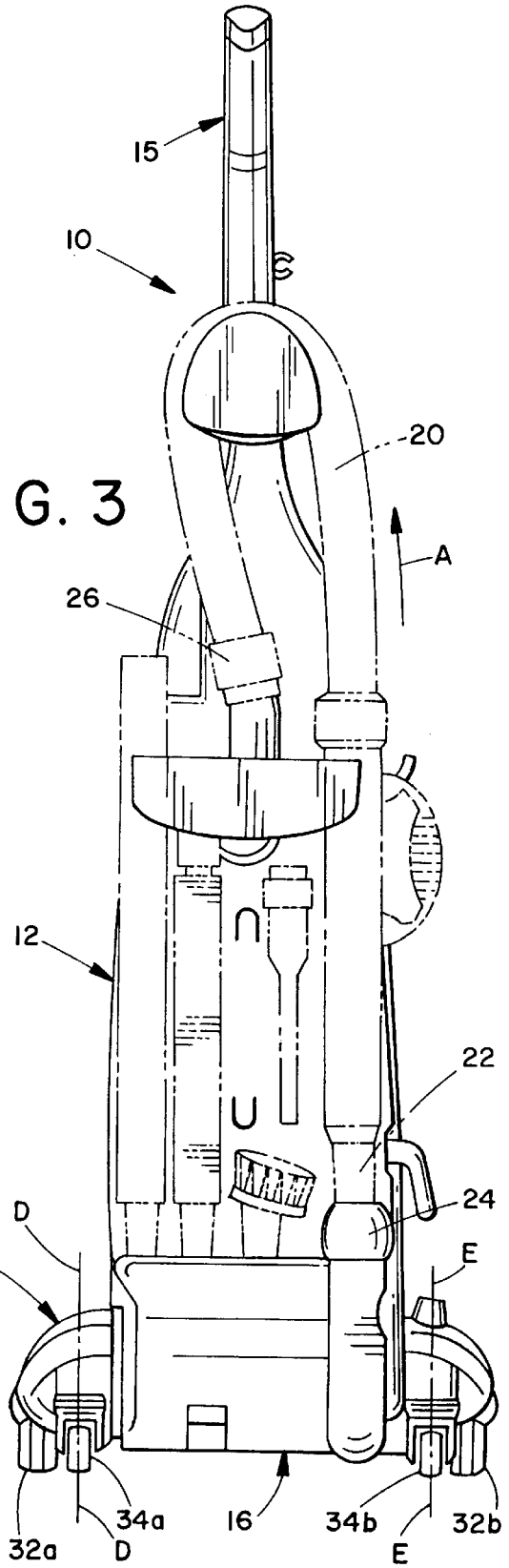
FIG. 3 is a rear elevational view of the upright vacuum cleaner illustrated in FIG. 1.

Referring now to the drawings, wherein the showings are for purposes of illustrating preferred embodiments of the invention only and not for purposes of limiting the same, FIG. 1 shows an upright vacuum cleaner in accordance with a first embodiment of the present invention. The vacuum cleaner includes a housing 10 having an upper section 12 and a lower cleaning nozzle section 14. It can be seen in FIG. 2 that the upper section 12, which can be made of a suitable conventional plastic, is a housing which encloses a dirt and dust collecting filter bag 13 and a suction source such as a motor and fan assembly M since a vacuum cleaner with a "clean air" system is disclosed. The upper section 12 also includes a handle 15 by which an operator of the vacuum cleaner grasps and maneuvers the vacuum for vacuuming operations as is well known. Those skilled in the art will recognize that the upper section 12 may alternatively be provided simply as an elongated handle member with a dirt and dust collecting filter bag attached thereto, if the vacuum cleaner has a "dirty air" system. The nozzle 14 is hingedly connected to the upper section 12 such that the upper section 12 pivots between an approximately vertical storage position as is shown in FIGS. 1–3 and an inclined operative position (not shown) for vacuuming operation.

During vacuuming operations, the cleaning nozzle 14 travels across the floor, carpet, or other subadjacent surface being cleaned, with its underside 16 in proximity therewith. The underside 16 of the nozzle 14 includes a main suction opening 18 through which dirt, dust, and other debris on the surface being cleaned are suctioned into the vacuum cleaner. The main suction opening 18 is in fluid communication with the filter bag 13 through a conduit such as hose 20. With reference now to FIG. 3, the hose 20 includes a first end 22 connected in fluid communication with the suction opening 18 (FIG. 4) of the nozzle 14 through a fitting 24 and a second end 26 connected in fluid communication with the filter bag 13 (FIG. 2) in the upper section 12. As shown in FIG. 2, a rotating cylindrical brush assembly 28 is provided within the main suction opening 18 for contacting and scrubbing the surface being vacuumed to loosen embedded dirt and dust.

As is known, the vacuum cleaner includes a vacuum or suction source such as an electric motor and vacuum fan assembly M (FIG. 2) enclosed within upper section 12 of the housing 10. The motor and fan assembly M or other suitable suction source operates to generate the required suction force to clean floors and rugs as is generally known in the art. In this embodiment, the vacuum source M is located downstream of the filter bag 13 and pulls air through the main suction opening 18, the hose 20, and the filter bag 13. Dirt and dust particles in the air are trapped within the bag as the air passes therethrough to constitute a "clean air" system. Thus, a suction force pulls air through the hose 20 in the direction indicated by arrow A in FIG. 3. As is described in further detail below, the first end 22 of hose 20 is selectively detachable from the nozzle 14 at disconnect fitting 24 to completely interrupt the suction force to the main suction opening 18 on the underside of nozzle 14.

Figure 4:
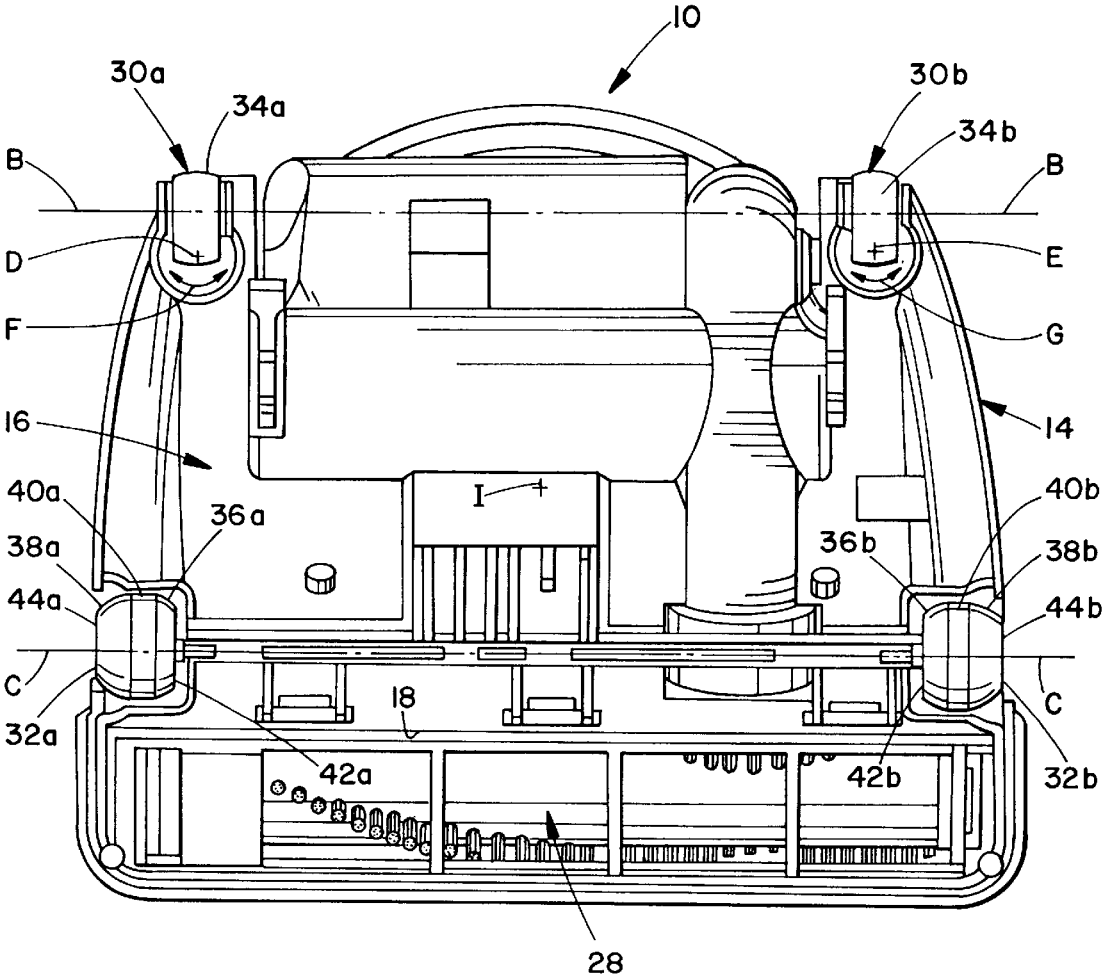
FIG. 4 is a bottom plan view of the upright vacuum cleaner illustrated in FIG. 1.

With reference now to FIG. 4, the housing 10, and in particular the nozzle 14, is supported above the surface being cleaned, in proximity therewith, by a plurality of wheels. Specifically, the underside 16 of nozzle 14 includes at least one, and preferably first and second casters 30*a*, 30*b* located adjacent a rear edge of the nozzle 14 in opposite corners thereof. A forward edge of the nozzle 14 includes the brush assembly 28. First and second forward wheels 32*a*, 32*b* are also provided on opposite lateral sides of the nozzle 14 in front of the casters 30*a*, 30*b*. The first and second forward wheels 32*a*, 32*b* are rotatable about a rolling axis, such as an essentially horizontal axis C, but are otherwise fixed relative to underside 16 of nozzle 14. The first and second casters 30*a*, 30*b* respectively include wheels 34*a*, 34*b* that are each rotatable about a rolling axis such as the horizontal axis B. However, casters 30*a*, 30*b* are also rotatable about vertical axes D and E, respectively. Thus, as is shown in FIG. 4, caster 30*a* is pivotable about axis D as indicated by arrow F and caster 30*b* is pivotable about axis E as indicated by arrow G. Those skilled in the art will recognize that the presence of the non-pivotable forward wheels 32*a*, 32*b* facilitates the control or tracking of the housing 10 during the repetitive back and forth motion required for cleaning operations while the pivotable casters 30*a*, 30*b* provide a pivoting movement of the nozzle 14 about a vertical axis I extending through the nozzle 14.

FIG. 4 shows most clearly the preferred configuration of the forward wheels 32*a*, 32*b* for the nozzle 14. Specifically, to facilitate the pivoting of the nozzle 14 about a vertical axis I extending through the nozzle 14 and to facilitate the lateral sliding movement of the forward wheels 32*a*, 32*b* during such pivoting, each wheel 32*a*, 32*b* respectively includes a curved inner edge 36*a*, 36*b* and a curved outer edge 38*a*, 38*b*. The curved inner edges 36*a*, 36*b* provide a smooth transition between the rolling surface 40*a*, 40*b* of each wheel 32*a*, 32*b* and the vertical inner sides 42*a*, 42*b* and the curved outer edges 38*a*, 38*b* likewise provide a smooth transition between the rolling surfaces 40*a*, 40*b* and the outer vertical sides 44*a*, 44*b* of the wheels 32*a*, 32*b*. This smooth transition allows the wheels 32*a*, 32*b* to move laterally across a surface without scraping or otherwise becoming engaged therewith. For example, it has been found desirable to form curved inner edges 36*a*, 36*b* and curved outer edges 38*a*, 38*b* with at least a partially spherical radius of curvature to provide a smooth transition region between the rolling surfaces 40*a*, 40*b*, the inner sides 42*a*, 42*b*, and the outer sides 44*a*, 44*b* of each wheel 32*a*, 32*b*, respectively.

Figure 5:
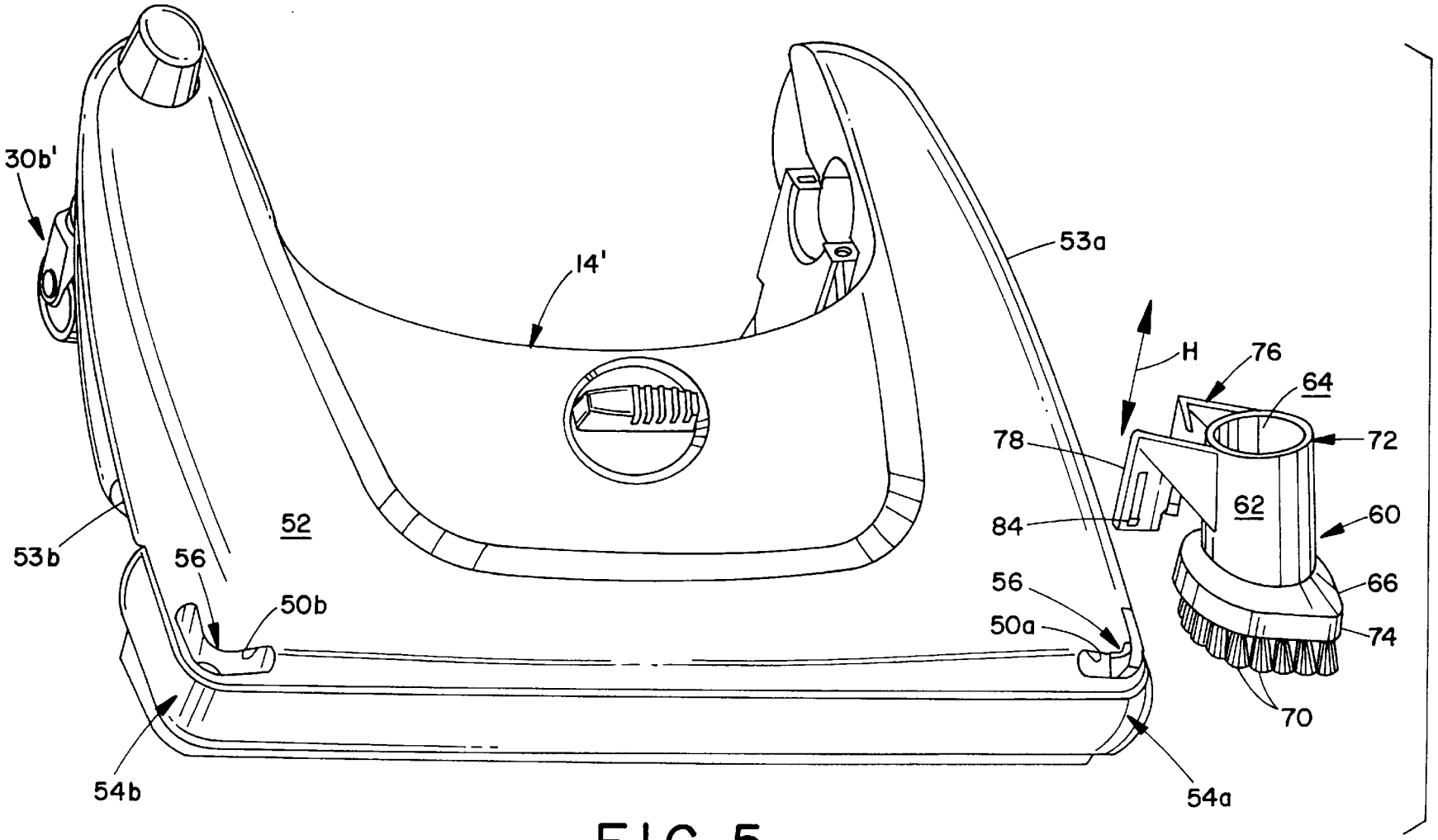
FIG. 5 is an exploded perspective view illustrating a nozzle portion and an edge cleaning tool of an upright vacuum cleaner in accordance with a second embodiment of the present invention.

FIGS. 5–8C show an alternate embodiment of a nozzle according to the present invention. This embodiment is similar in all respects to the nozzle 14 but further includes an edge and corner cleaning system. For ease of understanding and appreciation of this embodiment, like components are identified by like numerals with a primed (') suffix, and new components are identified by new numerals. With reference now to FIG. 5, a nozzle 14' includes first and second edge cleaning tool sockets 50*a*, 50*b* formed in a nozzle cover 52 at opposite lateral sides 53*a*, 53*b* thereof. The sockets 50*a*, 50*b* are preferably located in opposite forward corners 54*a*, 54*b* of the nozzle 14' as shown and include a bend or curve 56 therein of approximately 90 degrees such that the sockets 50*a*, 50*b* are generally "V-shaped" and conform to the shape of their respective corners 54*a*, 54*b* of the nozzle cover 52. It has been found desirable to locate the sockets 50*a*, 50*b* at the forward corners 54*a*, 54*b* of nozzle 14' such that both corner and edge cleaning can be easily achieved.

An upright vacuum cleaner housing including the nozzle 14' also includes an edge and corner cleaning tool 60 which is selectively and alternatively received in one of the sockets 50*a*, 50*b* for edge and corner cleaning from either lateral side 53*a*, 63*b* of the nozzle 14'. Thus, for cleaning edges and corners adjacent to lateral edge 53*a* of nozzle 14', the edge cleaning tool 60 is selectively connected to nozzle 14' in socket 50*a*. For cleaning edges and corners adjacent to opposite lateral edge 53*b* of nozzle 14', the edge cleaning tool 60 is selectively connected to nozzle 14' in socket 50*b*. Other than their location in opposite corners 54*a*, 54*b* of nozzle 14', sockets 50*a*, 50*b* are similar in all respects. The edge/corner cleaning tool 60 is slidably received in and slidably disengaged from each socket 50*a*, 50*b* as indicated by the arrow H in FIG. 5.

Figure 8A:
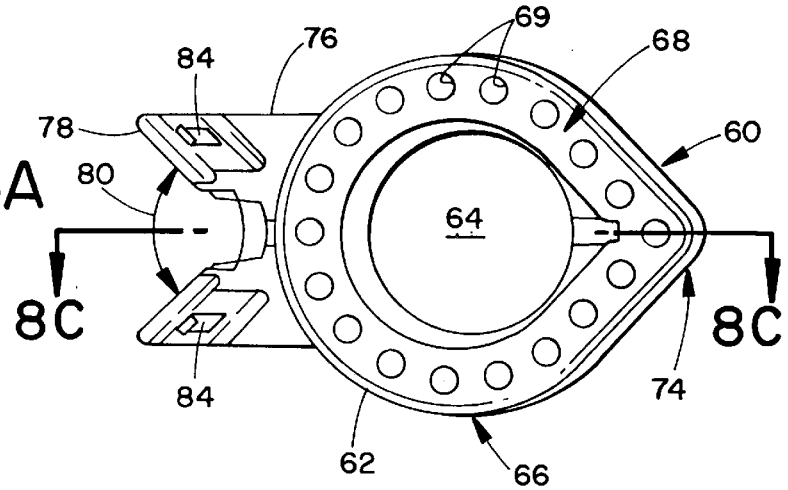
FIG. 8A is a bottom plan view of an edge cleaning tool employed with the nozzle portion of FIG. 5, with the brush bristles not shown for clarity.
Figure 8B:
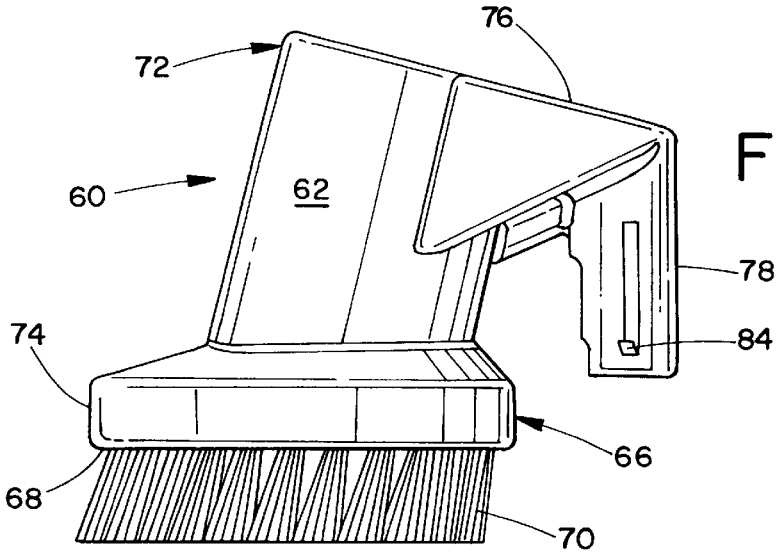
FIG. 8B is a side elevational view of the edge cleaning tool of FIG. 8A; and, FIG. 8C is a cross-sectional view along line 8C—8C of the edge cleaning tool of FIG. 8A.
Figure 8C:
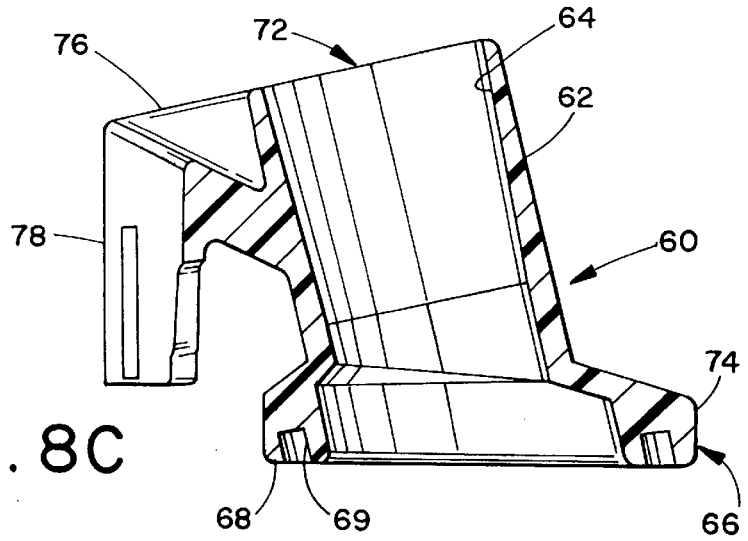

With reference now to FIG. 8C, the edge cleaning tool 60 includes a body 62 having a suction bore 64 extending therethrough. A flanged lower portion 66 of the body 62 includes a lower surface 68 which is in proximity with the surface being cleaned when tool 60 is connected to nozzle 14'. The surface 68 preferably includes a plurality of spaced sockets 69 in which brush bristles 70 (FIG. 8B) can be secured. The bristles 70 surround the bore 64 for loosening dirt and dust from the surface being cleaned. The bristles 70 also form a curtain around the bore 64 to improve suction and to inhibit the escape of airborne dust and dirt particles dislodged from the subadjacent surface by the bristles 70.

An upper region 72 of the tool 60 selectively connects with a first end of a hose, such as the hose end 22 in FIG. 3, such that the bore 64 of the tool 60 is in fluid communication with the hose. Those skilled in the art will recognize that when the end of the hose is connected to the edge/corner cleaning tool 60 in this manner, all of the available suction is directed to the bore 64 of the tool 60, and no suction force is present at a main suction opening 18' (FIG. 6) formed in the underside 16' of the nozzle 14'. This results in more effective extraction of the dirt, dust, and debris found along the edges and in the corners of a room. As is evident from FIGS. 5 and 8A, the lower flanged portion 66 of the cleaning tool 60 preferably converges into a "V-shaped" tip 74 such that the tool 60 extends into corners as far as possible to facilitate the most effective cleaning thereof.

Figures 6, 6A:
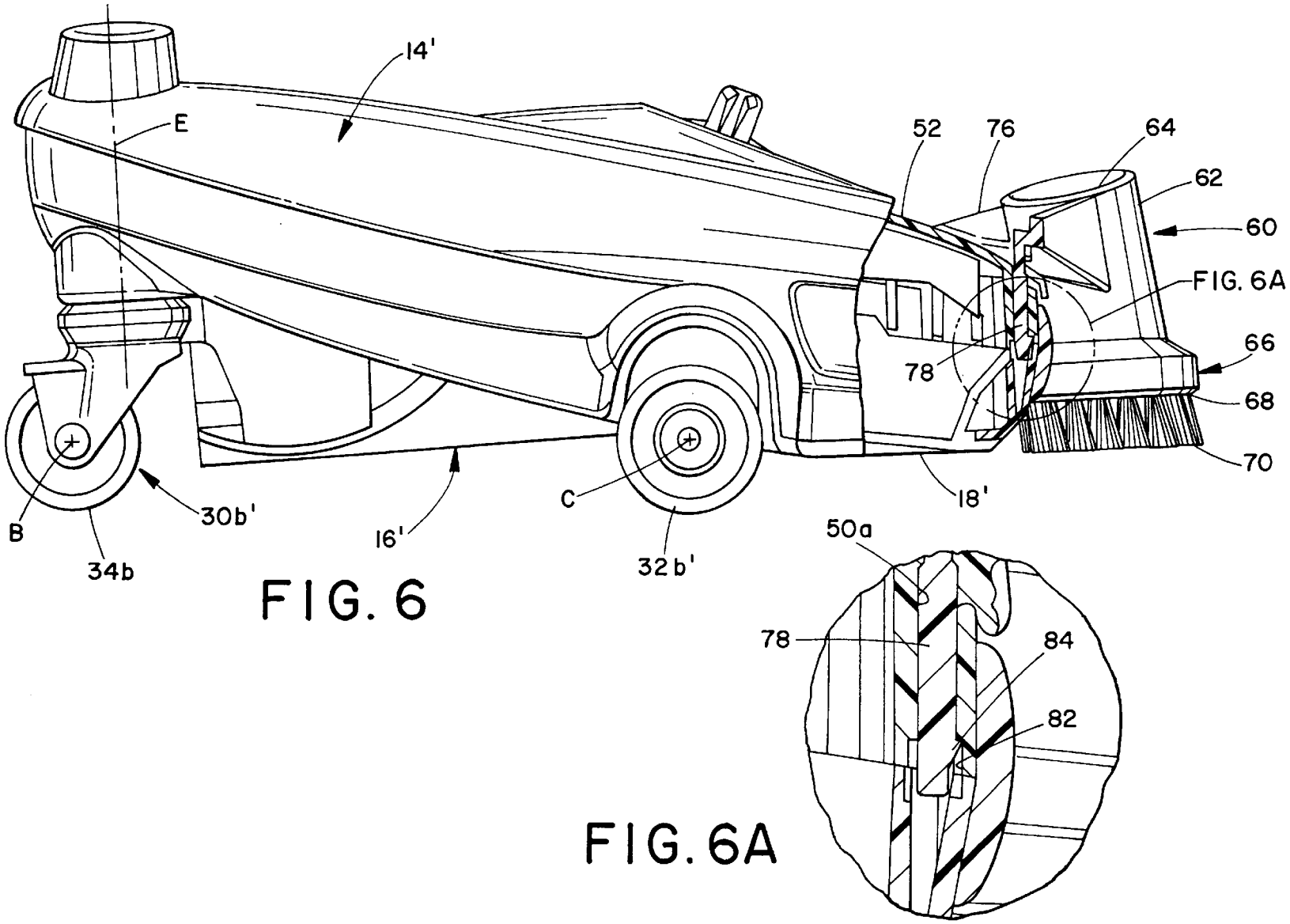
FIG. 6 is a side elevational view, with a portion broken away in cross-section, of the nozzle portion of FIG. 5.
FIG. 6A is an enlarged view of portion 6A of FIG. 6.

The edge and corner cleaning tool 60 is easily and selectively secured to the nozzle 14' in either of the sockets 50*a*, 50*b*. Furthermore, the arrangement for connecting the tool 60 to the nozzle 14' as described herein positively secures the cleaning tool 60 in the socket 50*a*, 50*b* such that the tool is not subject to accidental disengagement from the nozzle 14'. Specifically, the tool 60 includes a fastener such as an attachment arm 76 extending therefrom in a location opposite the tip 74. The arm 76 includes a connection flange 78 depending therefrom that is shaped to correspond to the shape of each socket 50*a*, 50*b* formed in the cover 52 of the nozzle 14' such that the flange 78 is selectively and alternatively slidably received in the sockets 50*a*, 50*b* as is shown in FIG. 6. Those skilled in the art will recognize that a connection flange or other suitable fastener may alternatively be provided as a part of the nozzle cover 52, with a socket to accept the fastener being formed in the edge cleaning tool 60.

From FIG. 8A, it can be seen that the connection flange is "V-shaped" in the same manner as each socket 50*a*, 50*b* and has a bend or curve 80 that corresponds to the bend or curve 56 of each socket 50*a*, 50*b*. The V-shaped configuration of each socket 50*a*, 50*b* and the corresponding V-shaped configuration of the connection flange 78 provides a superior connection of the tool 60 to the nozzle 14' and prevents unwanted twisting and other movement of the tool 60 relative to the nozzle 14'. Furthermore, the V-shaped tip 74 of the tool 60 extends outward from one of the corners 54*a*, 54*b* of the nozzle 14' upon the engagement of the flange 78 with one of the sockets 50*a*, 50*b* such that the V-shaped tip 74 of the tool extends as far as possible into the corner of the room being cleaned.

Figures 7, 7A:
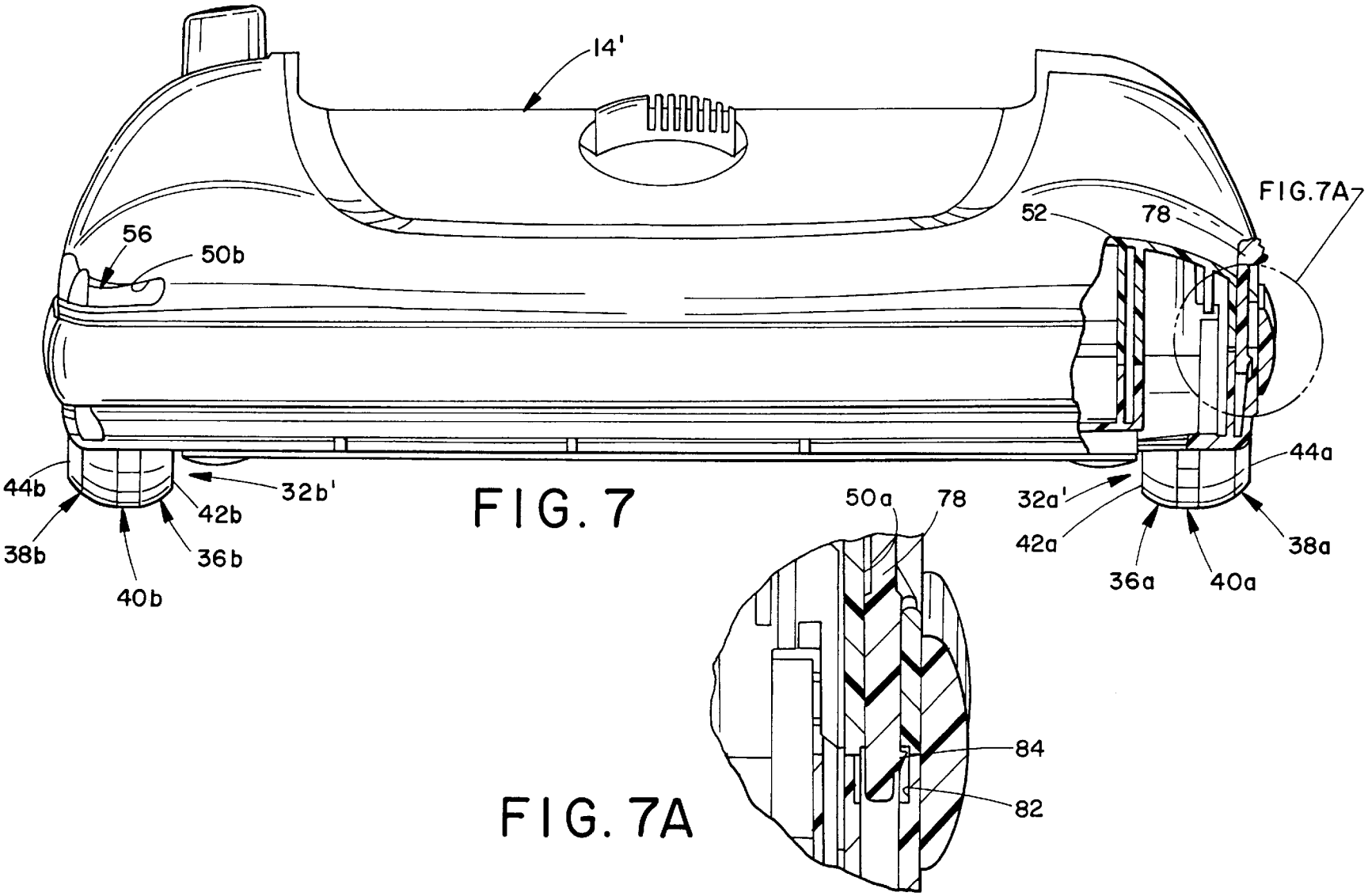
FIG. 7 is an enlarged front elevational view with a portion broken away in cross-section, illustrating the nozzle portion of FIG. 5.
FIG. 7A is an enlarged view of portion 7A of FIG. 7.

To ensure the positive connection of the edge cleaning tool 60 with nozzle 14', each socket 50*a*, 50*b* includes at least one, and preferably two recesses 82 formed in a wall thereof as is shown in FIGS. 6A and 7A. As shown in FIG. 8A, the connection flange 78 of the tool 60 correspondingly includes at least one, and preferably two projections 84 extending therefrom that become engaged within a recess 82 upon the complete insertion of the flange 78 into one of the sockets 50*a*, 50*b* as is shown in FIGS. 6–7A such that the flange is releasably engaged within one of the sockets 50*a*, 50*b* with a snap fit. Each projection 84 is shaped such that upon the application of sufficient upward operator pulling force, the contact between each projection 84 and its recess 82 deflects the connection flange 78, due to the resilient nature of the material from which the arm 76 is made, such that each projection 84 disengages from its recess 82, allowing the tool 60 to be pulled from the socket 50*a*, 50*b*.

It has been found preferable to manufacture the nozzle cover 52 and the tool 60, including the connection arm 76, from a variety of conventional resilient materials such as thermoplastics. More specifically, the tool 60 can be made from acetal and the nozzle cover 52 from ABS. In this manner, the tool 60 is positively retained in one of the sockets 50*a*, 50*b* for edge and corner cleaning operations. But, removal of the tool 60 from its socket 50*a*, 50*b* is easily accomplished by an upward pulling motion thereon by the operator of the vacuum since at least one of the connection arm 76 and the nozzle cover 52 flexes. Upon the completion of edge cleaning operations as described, the end of the hose is reconnected to a fitting, such as fitting 24 in FIG. 2, on the nozzle 14' to restore suction to the main suction opening 18' of the nozzle 14'. The edge cleaning tool 60 may be disconnected from its socket 50*a*, 50*b* or may be left in this operative position within the socket 50*a*, 50*b* for later edge and corner cleaning operations.

The improved maneuverability provided by the casters 30*a*, 30*b* and the smoothly transitioned forward wheels 32*a*, 32*b* is particularly desirable with nozzle 14' in light of the need to position the nozzle 14' adjacent to edges and corners for cleaning dirt and debris from these regions. Proper edge/corner cleaning requires that the nozzle 14' be maneuvered adjacent to edges and into corners of a room with a minimum of effort, preferably without requiring the operator of the vacuum to lift the underside 16 of the nozzle 14' away from the surface being cleaned. Thus, nozzle 14' preferably includes the casters 30*a*', 30*b*' and the smoothly transitioned forward wheels 32*a*', 32*b*' as described above with relation to the nozzle 14 of FIG. 4.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An upright vacuum cleaner comprising:

an upper section including a handle;

a lower cleaning nozzle section including an underside with a main suction opening formed therethrough;

first and second laterally spaced casters extending from said underside of said nozzle, each of said first and second casters being pivotable relative to said nozzle and including a wheel rotatable about a rolling axis; and, first and second laterally spaced fixed wheels positioned forward of said first and second casters and rotatable about only a single rolling axis, each of said first and second forward wheels including a rolling surface and curved inner and outer transition surfaces connecting said rolling surface to inner and outer wheel sides, respectively.

2. An upright vacuum cleaner as set forth in claim 1 wherein said inner and outer curved transition surfaces each comprise a spherical radius of curvature.

* * * * *